United States Patent [19]

Soneda et al.

[11] Patent Number: 4,485,380

[45] Date of Patent: Nov. 27, 1984

[54] LIQUID CRYSTAL MATRIX DISPLAY DEVICE

[75] Inventors: Mitsuo Soneda, Zama; Takaji Ohtsu, Hatano; Ken Kutaragi, Kawasaki, all of Japan

[73] Assignee: Sony Corporation, Tokyo, Japan

[21] Appl. No.: 386,432

[22] Filed: Jun. 8, 1982

[30] Foreign Application Priority Data

Jun. 11, 1981 [JP] Japan ..... 56-90053

[51] Int. Cl.[3] ..... G09G 3/36

[52] U.S. Cl. ..... 340/784; 340/752; 350/333

[58] Field of Search ..... 340/784, 783, 775, 811, 340/765, 752; 350/331 R, 332, 333

[56] References Cited

U.S. PATENT DOCUMENTS

| | | | |
|---|---|---|---|
| 3,851,212 | 11/1974 | Umeda et al. | 340/775 |
| 3,982,239 | 9/1976 | Sherr | 340/784 |
| 3,995,942 | 12/1976 | Kawakami et al. | 340/784 |
| 4,099,855 | 7/1978 | Wisbey et al. | 350/333 |
| 4,277,786 | 7/1981 | Waldron | 340/784 |
| 4,449,125 | 5/1984 | Clerc et al. | 340/784 |

*Primary Examiner*—Gerald L. Brigance
*Attorney, Agent, or Firm*—Lewis H. Eslinger; Alvin Sinderbrand

[57] ABSTRACT

A liquid crystal matrix display device has a plurality of liquid crystal display elements arranged in an X-Y matrix pattern. Vertical transmitting lines are connected to all of the display elements of each column, and horizontal transmitting lines are connected to each of the display elements of each row. Each of the vertical lines is connected through an input switching element to an input circuit to receive a video input signal and a horizontal pulse generator provides sequential pulse signals to control terminals of the input switching elements. In order to compensate for crosstalk that occurs because of parasitic capacitance between the vertical transmitting lines and the liquid crystal display elements, auxiliary lines are provided for the columns of such display elements, and each has a predetermined compensating capacitance relative to its associated liquid crystal display elements. A compensating signal, which is an inverted version of the video signal, is applied in succession to the auxiliary lines to compensate for any crosstalk.

7 Claims, 12 Drawing Figures

$\phi_{V1}$
$\phi_{V3}$ $\phi_{H1}$
$\phi_{H2}$
$\phi_{H3}$
$\phi_{Hm}$
$T_{HE}$

LIQUID CRYSTAL MATRIX DISPLAY DEVICE

BACKGROUND OF THE INVENTION

1. Field of the Invention

This invention relates generally to a two-dimensional address or matrix device, and is more particularly directed to a two-dimensional display device employing liquid crystals.

2. Description of the Prior Art

It has been previously proposed to display a television picture on a liquid-crystal display device. Normally, such a device employs a plurality of picture element units disposed in an X-Y array or matrix, with each picture element unit being formed of a liquid crystal cell and a switching element, which can be an FET. Generally, the picture element units are arranged in n horizontal rows and m vertical columns. A horizontal scanning pulse generator, normally formed of a shift register, has m output terminals and cycles once for each horizontal line interval of an input video signal, so each of the m outputs is high for a fraction 1/m of the picture portion of a horizontal line interval. A vertical scanning pulse generator, normally formed as a shift register, has n output terminals, and cycles once each frame interval (i.e., odd output terminals are made high in turn during odd field intervals, and even output terminals are made high in turn during even field intervals).

Vertical signal transmitting lines are respectively connected to all of the n switching elements of each column, and horizontal signal transmitting lines are respectively connected to each of the m switching elements of each row. Each of the m vertical lines is connected to an output terminal of a respective input switching element, which has an input terminal connected to a signal input to receive a video input signal and has a control electrode connected to a respective one of the m output terminals of the horizontal scanning pulse generator. The n horizontal lines are each connected to a respective one of the n output terminals of the vertical scanning pulse generator.

At any given moment, the input video signal is applied to a single one of the picture element units, namely, that one for which the horizontal and vertical scanning pulses are both high. Each of the liquid crystal cells has a signal charge imparted to it, in turn, and the optical transmissivity of each such liquid crystal cell is governed by its respective signal charge.

A new signal charge is given to each liquid crystal cell during each video frame.

The liquid crystal display device so constructed presents a video picture formed of a mosaic of these cells, each having a particular optical transmissivity as governed by the level of the video signal at the time that the associated vertical and horizontal scanning pulses are both high.

Each of the liquid crystal cells is formed as a capacitor with a liquid crystal layer sandwiched between a flat, transparent target electrode and a flat picture element electrode, with the same being connected by its respective switching element to the associated vertical signal transmitting line. The latter runs parallel to the picture element electrode and is separated therefrom by an insulating oxide layer. The liquid crystal cells each have a memory capacity $C_M$ for storing the signal charge applied thereto. Unfortunately, there is also a parasitic capacitance $C_S$ between the vertical signal transmitting lines and the liquid crystal elements.

Consequently, when an input signal charge, corresponding to a particular picture element of a video picture, is applied to a particular one of the liquid crystal cells for which the vertical and horizontal scanning pulse signals are both high, the parasitic capacitance $C_S$ causes a crosstalk signal to be applied to the remaining liquid crystal cells in each vertical column (for which cells the vertical scanning pulse signal is low). This signal has a level which is a factor $$C_S/(C_S+C_M)$$

times the level of the video input signal.

As a result of this crosstalk, if a bright or dark object appears in the video picture, light or dark vertical bars can appear on the display device emanating upward or downward from the object. This objectionable result occurs as a result of the structure of the conventional liquid crystal display device, and cannot be avoided merely by processing the video signal applied thereto.

OBJECTS AND SUMMARY OF THE INVENTION

Accordingly, it is an object of this invention to provide a liquid crystal display device of simple structure which avoids the aforesaid defects inherent in the prior art.

It is another object of this invention to provide a liquid crystal display device which avoids crosstalk.

It is still another object of this invention to provide a liquid crystal device which can display a pleasing high contrast picture without sacrifice of picture quality.

According to an aspect of the present invention, there is provided a liquid crystal matrix display device comprising a plurality of display elements (i.e., picture element units) arranged in X-axis and Y-axis directions to form an X-Y matrix pattern of predetermined number of rows and columns, disposed respectively in the X-axis and Y-axis directions. Each of the display elements includes a liquid crystal cell and a switching element connected therewith to supply a signal charge to the associated liquid crystal cell. An input signal voltage is provided to a signal input circuit and is distributed to the display elements over vertical transmitting lines each coupled to the switching elements of an associated column. A plurality of horizontal conductor lines are each coupled to the switching elements of an associated row. There are also provided input switching devices, each coupling the signal input circuit to a respective vertical transmitting line. A vertical scanning pulse generator has a predetermined number of outputs and provides sequential horizontal scanning pulses to control electrodes of the input switching elements, and a vertical scanning pulse generator provides sequential second scanning pulses to the horizontal conductor lines.

A parasitic capacitance exists between the vertical transmitting lines and the liquid crystal cells of the respective columns associated therewith. In order to compensate for any crosstalk owing to this parasitic capacitance, there are also provided auxiliary signal lines extending in the Y-axis direction parallel to and associated with respective vertical trasmitting lines. A predetermined compensating capacitance is established between these auxiliary signal lines and the liquid crystal cells of the respective column of display elements. Accordingly, a compensation voltage, which is an inverted version of the signal voltage, is applied to the auxiliary signal lines simultaneously with the application of the signal voltage to the associated vertical transmitting lines. In order to eliminate the crosstalk to the maximum extent possible, the compensation voltage should be selected to satisfy the relationship $$\frac{C_S}{C_S + C_M} V_S + \frac{C'_S}{C'_S + C_M} \overline{V_S} = 0$$

where $C_M$, $C_S$, $C'_S$, $\overline{V}_S$, the memory capacitance of the liquid crystal cell, the parasitic capacitance, the predetermined compensating capacitance, the level of the signal voltage, and the level of the compensation voltage, respectively.

The above and other objects, features, and advantages of this invention will become apparent from the ensuing description of preferred embodiments thereof, when considered in conjunction with the accompanying drawings through which the like reference characters identify the same elements and parts.

DETAILED DESCRIPTION OF A PREFERRED EMBODIMENTS

Initially, for purposes of background and to emphasize the advantages of this invention, a conventional liquid crystal television display device will be described with reference to FIG. 1.

In this conventional device, an input terminal 1, to which a video signal is applied, is connected to respective input electrodes of m switching elements $M_1$, $M_2$ . . . $M_m$, each formed in this example of an n-channel field-effect transistor (FET). Each of these switching elements $M_1$, $M_2$ . . . $M_m$ has an output electrode connected to a respective connected to a respective one of m transmission lines $L_1$, $L_2$, . . . $L_m$, which each extend in a vertical, or Y-axis direction. Here, there are m lines $L_1$ to $L_m$ corresponding to m picture elements in the horizontal, or X-axis direction.

A horizontal pulse signal generator 2 is formed of a shift register of m stages, each with a respective signal output. This generator 2 is provided with a clock signal having a frequency substantially $mf_H$, that is, m times the horizontal scanning frequency $f_H$ of the video signal. Accordingly, the generator 2 provides scanning signals $\phi_{H1}$, $\phi_{H2}$ . . . $\phi_{Hm}$ (FIG. 2B) appearing at respective output terminals thereof, to control electrodes of the respective switching elements $M_1$, $M_2$ . . . $M_m$.

The device also includes an array of picture element units each formed of a liquid crystal cell $C_{11}$, $C_{12}$ . . . $C_{nm}$ and an associated switching element $M_{11}$, $M_{12}$, . . . $M_{nm}$. These picture element units are arranged in m columns in the vertical, or Y-axis direction and n rows in the horizontal, or X-axis direction, and the first and second indexes associated with each of the cells $C_{11}$, $C_{12}$ . . . $C_{nm}$ and switching elements $M_{11}$, $M_{12}$, . . . $M_{nm}$ indicate the particular row and column therefor, respectively. Here the switching elements $M_{11}$, $M_{12}$ . . . $M_{nm}$ are shown to be FETs with an input electrode connected to the associated vertical line $L_1$, $L_2$ . . . $L_m$ and an output electrode connected to one side of the associated liquid crystal cell $C_{11}$, $C_{12}$, . . . $C_{nm}$. The other sides of the latter cells are connected to a target terminal 3 at which a target potential is applied.

A vertical pulse signal generator 4 formed of a shift register of n stages, and provided with flyback pulses as clocking pulses therefor, provides n vertical scanning signals $\phi_{V1}$, $\phi_{V2}$, . . . $\phi_{Vn}$ (FIG. 2A) (first for odd lines, then for even lines) at respective outputs thereof. These signals are provided to respective horizontal transmitting lines, each connected to control electrodes of all of the switching elements of a particular row $M_{11}$ to $M_{1m}$; $M_{21}$ to $M_{2m}$; . . . $M_{n1}$ to $M_{nm}$.

Figures 2A, 2B, 2C:
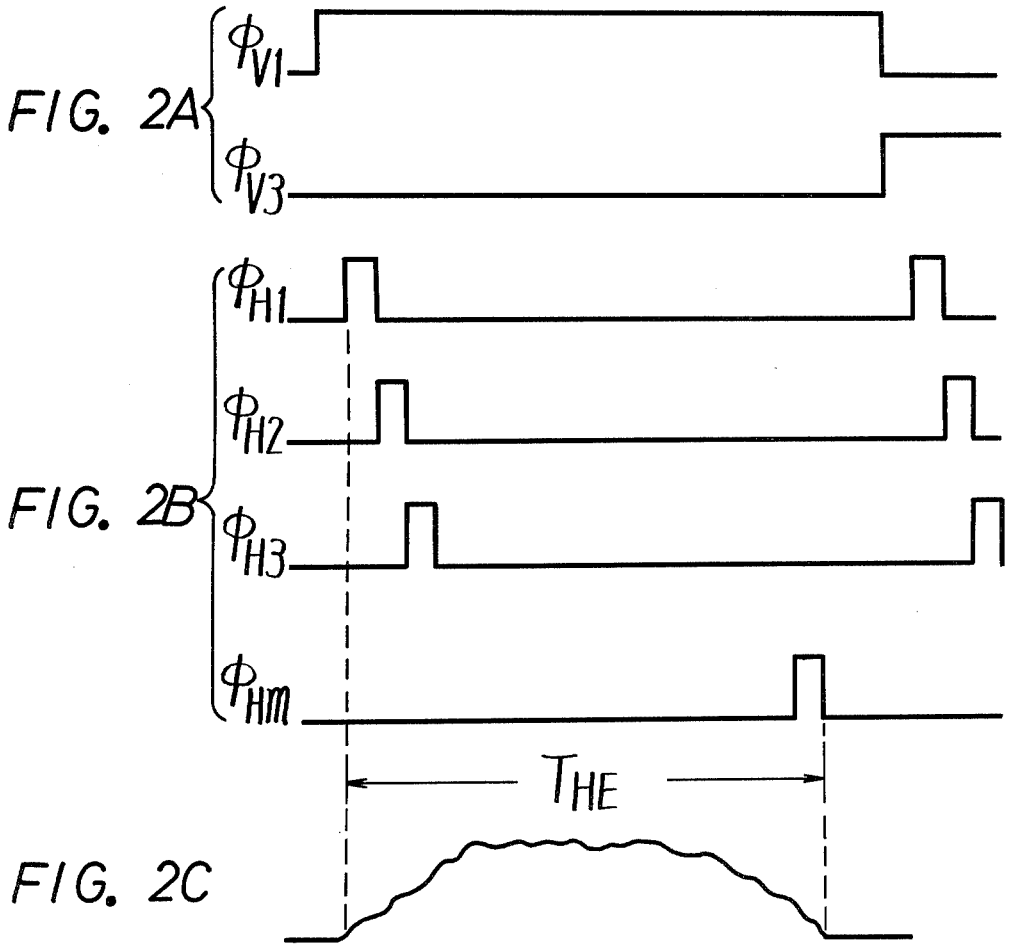
FIGS. 2A, 2B, and 2C are waveform diagrams used to explain the operation of the device of FIG. 1.

A typical horizontal interval of video information is shown in FIG. 2C.

The pulse signal generators 4 and 2 produce their respective scanning signals $\phi_{V1}$, $\phi_{V2}$ . . . $\phi_{Vn}$ and $\phi_{H1}$, $\phi_{H2}$ . . . $\phi_{Hm}$ as shown in FIGS. 2A and 2B, so that the vertical scanning signals $\phi_{V1}$, $\phi_{V2}$, . . . $\phi_{Vn}$ appear, in alternate succession, for a period equal to one horizontal interval, and the horizontal scanning signals $\phi_{H1}$, $\phi_{H2}$, . . . $\phi_{Hm}$ appear in succession with one cycle thereof $\phi_{H1}$ to $\phi_{Hm}$ occurring during an effective picture period $T_{HE}$ (FIG. 2C) of each horizontal interval.

When the scanning signals $\phi_{V1}$ and $\phi_{H1}$ are both produced by the generators 4 and 2 (i.e., both signals are high). The switching element $M_1$ is made ON to pass the video input signal to the line $L_1$, and the switching elements $M_{11}$ to $M_{1m}$ are made ON to form a current path from the input terminal 1, to the switching element $M_1$, to the vertical line $L_1$, to the switching element $M_{11}$, to the liquid crystal cell $C_{11}$, to the target terminal 3. Thus, when the signals $\phi_{V1}$ and $\phi_{H1}$ are both high, a signal charge corresponding to the electric potential difference produced by a first picture element of the video signal, is sampled by the switching elements $M_1$ and $M_{11}$ and is held by the capacitance of the liquid crystal cell $C_{11}$. This causes the optical transmissivity of the liquid crystal cell $C_{11}$ to be varied in accordance with the level of the first picture element of the video signal.

The same procedure is carried out for the remainder of the picture elements in the video signal so that each of the remainder liquid crystal cells $C_{12}$ to $C_{nm}$ has its optical transmissivity varied to correspond with the level of the respective picture element. Then, for each successive video frame, signal charges are again provided to the respective liquid crystal cells $C_{11}$ to $C_{nm}$.

The optical transmissivities of the various cells $C_{11}$ to $C_{nm}$ are varied from one picture element to another, and that of each cell $C_{11}$ to $C_{nm}$ is varied from one frame to the next, so that the device can display an effective video picture.

Figure 1:
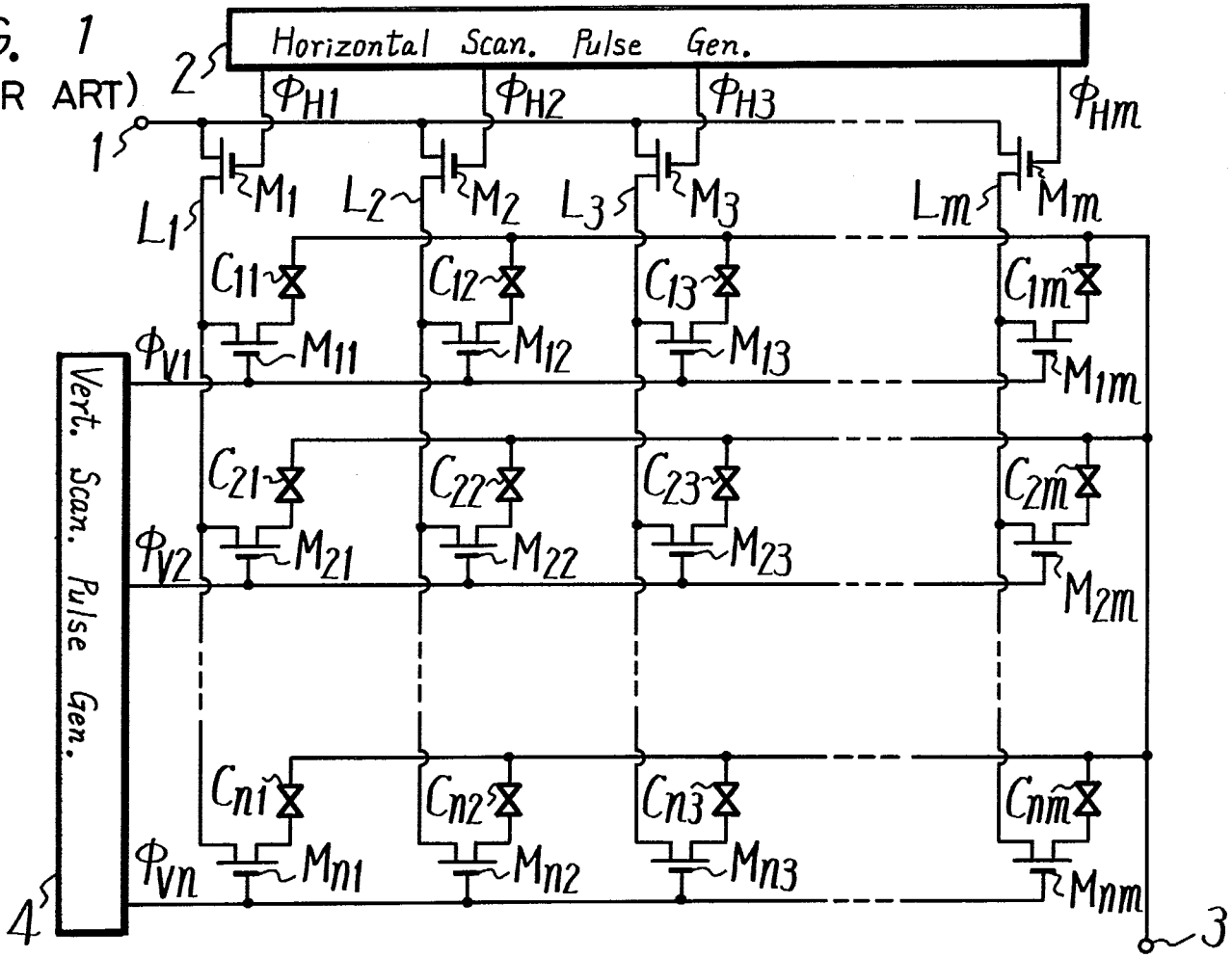
FIG. 1 (PRIOR ART)
FIG. 1 is a schematic diagram of a prior-art liquid crystal matrix display device.
Figure 3:
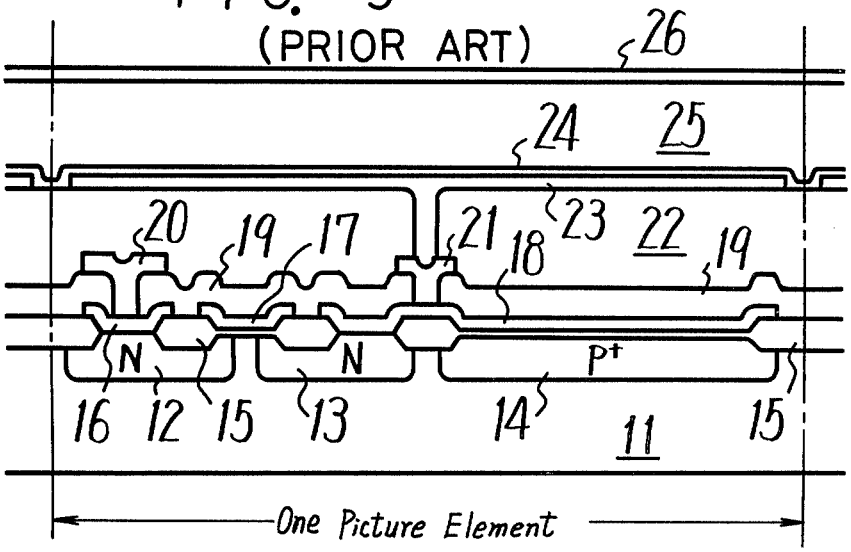
FIG. 3 (PRIOR ART)
FIG. 3 is a cross-sectional view of a liquid crystal cell used in the display device of FIG. 1.

In the conventional device of FIG. 1, each of the liquid crystal cells $C_{11}$ to $C_{nm}$ has the structure generally illustrated in FIG. 3.

As shown in vertical cross section in FIG. 3, each liquid crystal cell is formed on a P-type silicon substrate 11 on which there are formed N regions 12 and 13 and a P+ region 14 with an oxide ($SiO_2$) layer 15 deposited upon these regions 12, 13, and 14. A through-hole is formed in a portion of the oxide layer 15 overlying each of the N regions 12 and 13, and the oxide layer 15 is made thinner over a portion of the substrate 11 separating the regions 12 and 13, and also over the P+ region 14.

Polycrystalline silicon layers 16, 17, and 18 are respectively formed at one through-hole contacting the N region 12, on the thin portion of the oxide layer over the region of the substrate 11 separating the N regions 12 and 13, and at the other through-hole to contact the N region 13, respectively. This last polycrystalline layer 18 also extends over the P+ region 14.

An insulating (i.e., dielectric) oxide layer 19 is then formed atop these polycrystalline layers 16, 17, and 18.

A metal layer 20, forming a respective one of the vertical transmitting lines $L_1$ to $L_M$, extends in the Y-axis direction atop this oxide layer 19 and has a portion extending through a through-hole in the oxide layer 19 to contact the polycrystalline layer 16. Similarly, a metal layer 21 is provided atop the oxide layer 19, and this metal layer 21 extends through a through-hole in the oxide layer 19 to contact the polycrystalline layer 18.

Although not shown, a respective one of the horizontal lines is connected to the polycrystalline layers 17.

It should be apparent that the polycrystalline layers 16, 17, and 18 form the source, gate, and drain electrodes of a field effect transistor, so that when the polycrystalline layer 17 has a high potential applied thereto, any charge on the metal layer 20 is permitted to pass through to the metal layer 21.

A further oxide (i.e., dielectric) layer 22 is formed atop the oxide layer 19 and the metal layers 20 and 21, with a through-hole extending therethrough to the metal layer 21. A picture element electrode 23 formed atop the oxide layer 22 has a portion extending through the through-hole therein to contact the metal layer 21. On this electrode 23, an insulating layer 24 is provided. Then, a liquid crystal layer 25 is sandwiched between an insulating layer 24 on the picture element electrode 23 on one side and a transparent target electrode 26 on the other side. This target electrode 26 is connected to the target terminal 3, to which a target potential is applied.

Accordingly, in the liquid crystal cell of FIG. 3, when a signal voltage is applied from the metal layer 20 to the polycrystalline layer 16, and at the same time a high level is applied to the polycrystalline layer 17, the signal voltage is passed through the metal layer 21 to the picture element electrode 23. Thereafter, a signal charge, corresponding to the voltage difference between the signal voltage and the target potential, is stored in the memory capacity $C_M$ between the picture element electrode 23 and the target electrode 26. This charge so stored varies the optical transmissivity of the liquid crystal layer 25 in accordance with such voltage difference.

Figure 4:
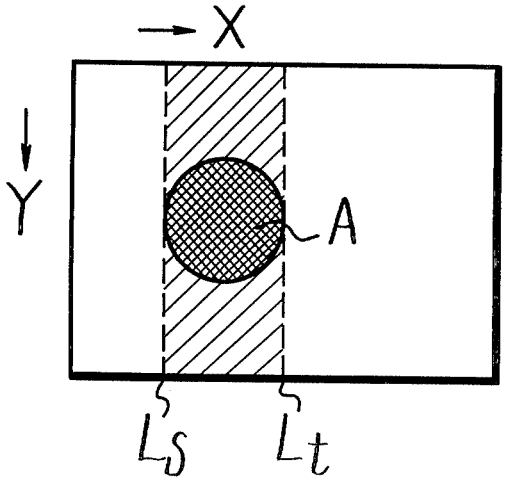
FIG. 4 (PRIOR ART)
FIG. 4 is a plan view of a portion of the display device of FIG. 1 showing adverse effects due to crosstalk.

Unfortunately, a parasitic capacity $C_S$ is formed between the metal layer 20 and the picture element electrode 23. This parasitic capacity $C_S$ results in crosstalk of the signal voltage to other liquid crystal cells aligned in the Y-axis direction. That is, as shown in FIG. 4, if a high contrast picture is to be presented, for example, containing a dark disk A as shown in FIG. 4, a signal voltage at a high level must be delivered to a succession of vertical transmitting lines from $L_s$ to $L_t$, which corresponds to the horizontal limits of the object A. The video signal voltage is applied not only to the desired liquid crystal cells, but also, through the parasitic capacity $C_S$, to other liquid crystal cells $C_{1s}$ to $C_{ns}$ . . . $C_{1t}$ to $C_{nt}$ aligned in the Y-axis direction. This parasitic capacity thus results in so-called crosstalk. In this instance, the crosstalk appears as a vertical bar apparently emanating from the dark disk A.

If the storage capacity of the liquid crystal cell is expressed as $C_M$, then, the crosstalk will have a value corresponding to the value of the input signal voltage times a factor $$C_S/(C_M+C_S).$$

It should be remarked that this crosstalk becomes more significant as the dimensions of the display device are decreased. This is because as the area of each liquid crystal cell is reduced, the storage capacity $C_M$ thereof is reduced. However, the parasitic capacity $C_S$ is substantially independent of the size of the liquid crystal cell, and thus does not decrease with the size of the liquid crystal cell.

Figure 5:
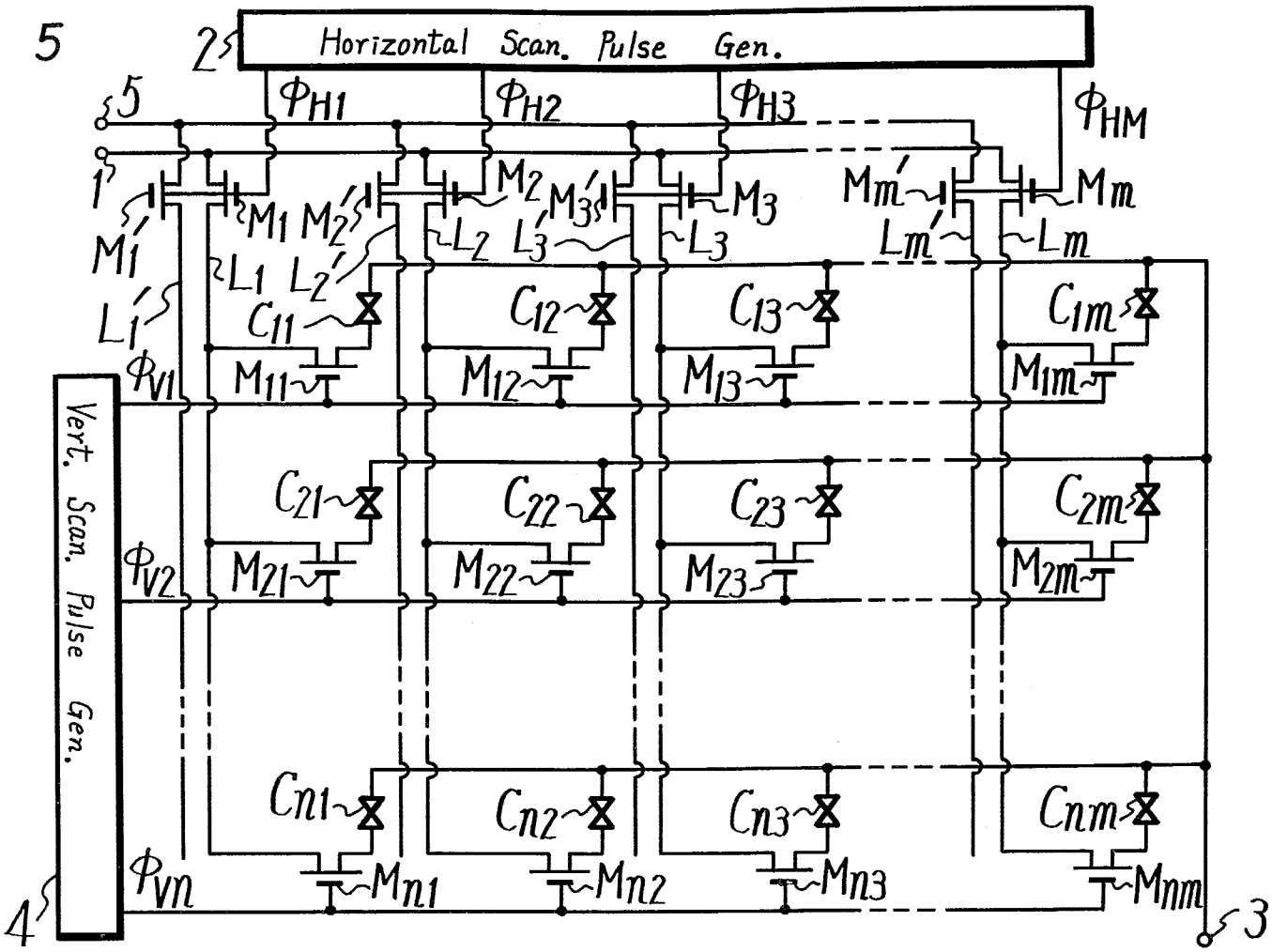
FIG. 5 is a schematic diagram of an embodiment of a liquid crystal matrix display device according to the present invention.

A first embodiment of this invention is shown in FIG. 5, wherein elements in common with the device of FIG. 1 are identified with the same reference characters and a detailed description thereof is omitted.

In this embodiment, auxiliary vertical lines $L_1'$ to $L_m'$ are provided in parallel to the vertical transmitting lines $L_1$ to $L_m$, and extend in the Y-axis direction. These auxiliary lines $L_1'$ to $L_m'$ are each coupled to an output electrode of a respective auxiliary switching element $M_1'$ to $M_m'$. Each of these auxiliary switching elements $M_1'$ to $M_m'$ has its control electrode joined to the control electrode of the associated switching elements $M_1$ to $M_m$. These auxiliary switching elements $M_1'$ to $M_m'$ have input electrodes connected to an auxiliary input terminal 5 to which is supplied a compensation signal, which has a phase opposite to that of the input signal supplied to the input terminal 1.

Figure 6:
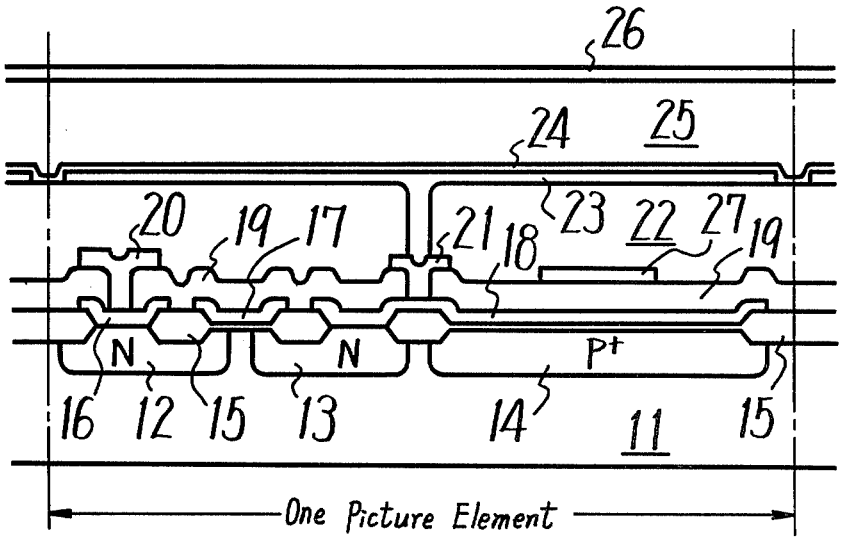
FIG. 6 is a cross-sectional view of a liquid crystal cell of the display device of FIG. 5.

FIG. 6 is a cross sectional view of a liquid crystal cell of the device according to this invention, and elements in common with the similar liquid crystal cell of FIG. 3 are identified with the same reference characters, and a detailed description thereof is omitted.

The liquid crystal cell shown in FIG. 6 has all of the elements of the liquid crystal cell of FIG. 3, and, in addition, further includes a metal layer 27 formed upon the part of the oxide layer 19 that overlies the P+ region 14, and spaced from the metal layer 21 opposite the side thereof on which the switching element transistor (i.e., regions 13–18) is formed. This metal layer 27 extends in the Y-axis direction and forms a respective one of the auxiliary lines $L_1'$ to $L_m'$.

Accordingly, in this embodiment, a compensating parasitic capacity $C_S'$ is formed between the metal layer 27 and the picture element electrode 23. Thus, a compensating crosstalk level is applied to the liquid crystal cell having a value $$\frac{C_S'}{C_M + C_S'}\,\overline{V_S}$$

where $\overline{V_S}$ is the level of the auxiliary signal.

In this case, if the auxiliary signal $V_s$ has the same potential as the input signal $V_S$, but has an opposite phase, that is, $\overline{V_S} = -V_S$, the metal layer 27 can be dimensioned so that the compensating parasitic capacity $C_S'$ satisfies the following equation $$\frac{C_S}{C_M + C_S} V_S - \frac{C_S'}{C_M + C_S'} V_S = 0 \quad (1)$$

With the liquid crystal cells so constructed, it is possible to eliminate any crosstalk caused by the parasitic capacity $C_S$ between the transmitting lines $L_1$ to $L_m$ (i.e., metal layer 20) and the picture element electrode 23. Of course, the value $C_S'$ of the compensating parasitic capacity can be easily tailored by selecting the width of the metal layer 27.

With the embodiment as particularly described hereinabove, a television picture with high contrast, that is, having very dark objects therein, can be displayed without the objectionable vertical bar of FIG. 4.

Further, if the construction of the liquid crystal cells does not permit making the value of the compensating parasitic capacity $C_S'$ equal to the value of the parasitic capacity $C_S$, it is possible to adjust the level of the signal supplied to the auxiliary input terminal 5 so that any crosstalk is completely eliminated. That is, if the input video signal $V_S$ is applied through an inverting circuit having a gain of k, and is thence supplied to the auxiliary input terminal 5, equation (1) above can be rewritten as follows:

$$\frac{C_S}{C_M + C_S} V_S - \frac{C_S'}{C_M + C_S'} k \times V_S = 0 \quad (1a)$$

The gain k can be adjusted so as to satisfy the following equation (2):

$$k = \frac{C_S}{C_S'} \cdot \frac{C_M + C_S'}{C_M + C_S} \quad (2)$$

Thus, with the level of the auxiliary signal so adjusted, it is possible to cancel any objectionable crosstalk.

Conversely, the width of the metal layer 27 can be selected so that the compensating parasitic capacity thereof satisfies the following equation $$C_S' = \frac{C_M \times C_S}{k(C_M + C_S) - C_S} \quad (3)$$

Figure 7A:
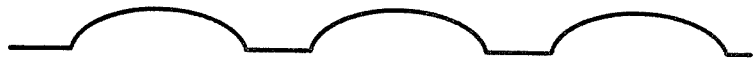
FIGS. 7A to 7D are waveform diagrams used to explain the operation of the display device of FIG. 5.
Figure 7B:
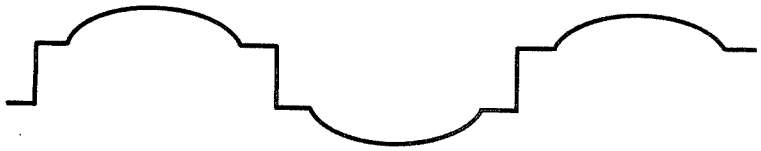
Figure 7C:
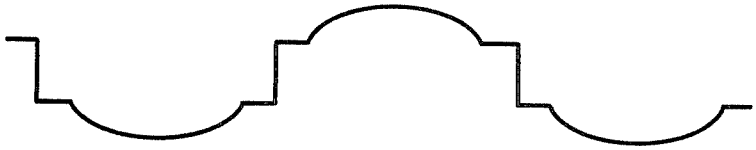
Figure 7D:
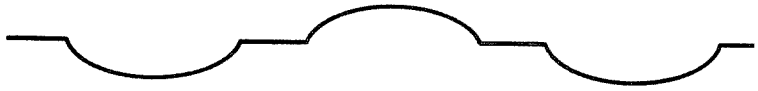

In several conventional devices, an AC signal is used to drive the liquid crystal cells, and such an AC signal can be employed in many possible embodiments of this invention. In such case, if the video signal has a waveform as shown in FIG. 7A, the input signal supplied to the input terminal 1 should have the waveform shown in FIG. 7B. Consequently, the auxiliary signal applied at the auxiliary input terminal 5 can have the waveform of opposite phase as shown in FIG. 7C. However, because it is unnecessary to apply any DC component, the auxiliary signal could instead have the waveform shown in FIG. 7D.

Of course, the present invention is not limited to the television display device as described above, but can also be embodied in a memory device having a two-dimensional matrix address, or in many similar devices.

While a preferred embodiment of this invention has been described in detail hereinabove, it is to be understood that the invention is not limited to that precise embodiment, and that many modifications and variations thereof are possible without departure from the scope and spirit of this invention, as defined in the appended claims.

We claim:

1. A liquid crystal matrix display device comprising a plurality of liquid crystal display elements arranged in a matrix pattern with rows of said display elements extending in an X-axis direction and with columns thereof extending in a Y-axis direction; a plurality of horizontal transmitting lines each extending in the X-axis direction and coupled to a respective one of said rows of said liquid crystal display elements; a plurality of vertical transmitting lines each coupled to a respective one of said columns of said liquid crystal display elements wherein a parasitic capacitance exists between said vertical transmitting lines and the liquid crystal display elements in the respective columns of such display elements associated with such vertical transmitting lines; means for sequentially applying a signal voltage to the vertical transmitting lines; means for sequentially applying a switching voltage to the horizontal transmitting lines; auxiliary signal lines provided in said Y-axis direction parallel to respective ones of said vertical transmitting lines and having a predetermined compensating capacitance with respect to the liquid crystal display elements in an associated column thereof; and signal generator means sequentially supplying an inverted version of said signal voltage as a compensation voltage to said auxiliary signal lines to cancel any crosstalk caused by the parasitic capacitance between the vertical transmitting lines and the liquid crystal display elements other than those in a row thereof to whose horizontal transmitting line the switch voltage is applied.

2. A liquid crystal matrix display device according to claim 1, wherein said parasitic capacitance has a capacitance value $C_S$, said predetermined capacitance has a capacitance value $C_S'$, said liquid crystal cells have a memory capacitance of a capacitance value $C_M$, and said signal generator means supplies said compensation voltage with a value $\overline{V_S}$ relative to the level of said signal voltage $V_S$ to satisfy the following relationship:

$$\frac{C_S}{C_M + C_S} V_S + \frac{C_S'}{C_M + C'_S} \overline{V_S} = 0.$$

3. A liquid crystal display device according to claim 2; wherein said compensating voltage has a value $-k\ V_S$, where k is a constant determined from the following equation:

$$k = \frac{C_S}{C'_S} \cdot \frac{C_M + C'_S}{C_M + C_S}.$$

4. A liquid crystal matrix display device according to claim 1; wherein each said liquid crystal display element includes a liquid crystal layer sandwiched between a target electrode and a picture element electrode, the latter being switchably connected to said vertical signal transmitting line, a dieletric layer on the side of said picture element electrode away from said liquid crystal layer, with an associated one of said vertical transmitting lines disposed on said dielectric layer spaced from said picture element electrode, and an associated one of said auxiliary signal lines disposed on said dielectric layer opposite said picture element electrode and spaced from said one of said vertical transmitting lines.

5. A liquid crystal matrix display device according to claim 3; wherein each of said liquid crystal display elements further includes a metal conductor coupled to said picture element electrode through said dielectric layer at a location spaced from said vertical transmitting line on one side of said metal conductor; a switching transistor formed on said dielectric layer switchably connecting said associated vertical transmitting line and said metal conductor in response to said switching voltage; and said associated auxiliary signal line is disposed on said dielectric layer on the side of said metal conductor opposite said vertical transmitting line and spaced from said metal conductor.

6. A liquid crystal matrix display device according to claim 4; wherein each said auxiliary signal line is formed of a metal layer having a width selected such that the compensating capacitance thereof is substantially equal to the parasitic capacitance of the respective vertical transmitting line relative to the associated liquid crystal display elements.

7. A liquid crystal matrix display device according to claim 1; wherein said means for sequentially applying the signal voltage to said vertical transmitting lines includes a shift register having a predetermined number of outputs providing sequential switching pulses, and a plurality of switching elements each having an input electrode to receive an input signal, an output electrode connected to a respective one of the vertical transmitting lines, and a control electrode coupled to a respective one of the outputs of said shift register; and said signal generator means includes a plurality of auxiliary switching elements each having an input electrode to receive a version of said input signal, an output electrode connected to an associated one of said auxiliary signal lines, and a control electrode coupled to the associated one of said outputs of said shift register.

* * * * *